US008555473B2

(12) United States Patent
Howes et al.

(10) Patent No.: US 8,555,473 B2
(45) Date of Patent: Oct. 15, 2013

(54) APPARATUS AND METHOD FOR TURBINE BLADE INSTALLATION

(75) Inventors: James Royce Howes, Hermon, ME (US); Eric Donald Anderson, Winterport, ME (US); Gregory Norman Fournier, Hermon, ME (US)

(73) Assignee: General Electric Company, Schenectady, NY (US)

( * ) Notice: Subject to any disclaimer, the term of this patent is extended or adjusted under 35 U.S.C. 154(b) by 954 days.

(21) Appl. No.: 12/652,029

(22) Filed: Jan. 4, 2010

(65) Prior Publication Data

US 2011/0162179 A1 Jul. 7, 2011

(51) Int. Cl.
*B21K 25/00* (2006.01)

(52) U.S. Cl.
USPC ..... 29/23.51; 29/889.21; 416/219 R

(58) Field of Classification Search
USPC ..... 29/23.51, 281, 453, 709, 889.21; 269/55; 416/219 R
See application file for complete search history.

(56) References Cited

U.S. PATENT DOCUMENTS

| | | | | |
|---|---|---|---|---|
| 1,269,144 | A * | 6/1918 | Williamson | 29/889.21 |
| 2,240,743 | A * | 5/1941 | Allen | 29/23.51 |
| 2,898,442 | A * | 8/1959 | Anderson et al. | 219/80 |
| 3,681,837 | A * | 8/1972 | Franklin | 29/889.5 |
| 4,096,614 | A | 6/1978 | Brungard | |
| 4,437,213 | A | 3/1984 | Reese | |
| 4,844,661 | A * | 7/1989 | Martin et al. | 405/232 |
| 6,061,886 | A | 5/2000 | Nitta | |
| 6,557,647 | B2 * | 5/2003 | White | 173/17 |
| 8,316,960 | B2 * | 11/2012 | Robson | 173/185 |
| 2009/0047128 | A1 | 2/2009 | Bracken | |

FOREIGN PATENT DOCUMENTS

| | | | |
|---|---|---|---|
| DE | 4409686 | A1 | 9/1995 |
| EP | 1955805 | A1 | 8/2008 |
| EP | 2083146 | A2 | 7/2009 |
| GB | 190900581 | A | 0/1909 |
| GB | 116517 | A | 6/1918 |

OTHER PUBLICATIONS

Search Report and Written Report for corresponding European Application No. 10196511-1267, dated Jul. 19, 2012.

* cited by examiner

*Primary Examiner* — Alexander P Taousakis
(74) *Attorney, Agent, or Firm* — Fletcher Yoder, P.C.

(57) ABSTRACT

Systems are provided for a blade installation tool. The blade installation tool may include a vertical guide having a vertical ram path. A ram may be disposed along the vertical guide. The ram can move along the vertical ram path between a lower position and an upper position at a height above the lower position. Gravity may drive the ram from the upper position toward the lower position to provide an impact force of the ram against a blade segment of a turbine or a compressor. The height of the upper position is variable so as to control the impact force.

20 Claims, 10 Drawing Sheets

APPARATUS AND METHOD FOR TURBINE BLADE INSTALLATION

BACKGROUND OF THE INVENTION

The subject matter disclosed herein relates to tools and methods for installing turbine blades into the stages of a turbine. More specifically, the subject matter discloses tools and methods for installing turbine blades into a turbine stage by using an impact force.

In general, turbine engines contain one or more stages of turbine blades having the blades (i.e., buckets) positioned circumferentially around an axis. Steam or combustion gases may flow through the one or more stages of turbine blades to generate power for a load (e.g., generator) and/or a compressor. The blades may be typically installed by incrementally sliding each blade circumferentially within a rotor disk. The final locking blade may then be installed by using an impact force to drive the locking blade into a proper position in the rotor disk. Typically, a tool such as a sledgehammer is used as the impacting tool. Multiple blows of the sledgehammer may be needed to properly wedge the locking blade into its final position. Unfortunately, a tool such as a sledgehammer is not easily targeted or controlled and results in an uneven impacting of the locking blade. Accordingly, there is a need for an impact tool and a method to easily target and impact a locking blade using a controlled, easily repeatable impact force.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a blade installation tool that may include a vertical guide having a vertical ram path and a ram disposed along the vertical guide. The ram may move along the vertical ram path from a lower position and an upper position at a height above the lower position. Gravity may drive the ram from the upper position to the lower position. The ram may be driven to impact a blade segment of a turbine or a compressor with a certain impact force. The height of the upper position may be variable in order to control the impact force.

In a second embodiment, a system includes a blade installation tool including a guide having a ram path and a ram. The ram is disposed along the guide path and is configured to move along the ram path between a first position and a second position offset from the first position. The ram may be driven from the first position toward the second position to provide an impact force of the ram against a blade segment of a turbine or compressor. An impact control may be configured to adjust the impact force.

In a third embodiment, a system includes a blade installation tool that may include a frame having a vertical guide path and a vertical guide coupled to the frame. The vertical guide may be configured to move along the vertical guide path between a lower guide position and an upper guide position at a guide height above the lower guide position. The vertical guide may include a vertical ram path parallel with the vertical guide path. The blade installation tool may also include a guide lift configured to move the vertical guide along the vertical guide path and a ram coupled to the vertical guide.

The ram may be configured to move along the vertical ram path between a lower ram position and an upper ram position at a ram height above the lower ram position. The ram can be driven by gravity from the upper ram position toward the lower ram position in order to provide an impact force of the ram against a turbine blade of a turbine engine or compressor. The ram height of the upper ram position is variable in order to control the impact force. The blade installation tool may also include a ram lift configured to move the ram along the vertical ram path.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The disclosed embodiments include systems and methods for installing turbine and compressor blades, including integrally covered buckets (ICBs), by targeting and impacting a blade in a radial direction relative to a rotational axis of a turbine or a compressor. For example, an impact tool of the disclosed embodiments includes a targeting system (e.g., a guide having a ram path) to target an impact ram at an impact point on a blade, thereby enabling precise application of an impact force on the blade. The targeting system also provides repeatable application of the impact force on the blade from one strike to another by the impact ram. In other words, rather than allowing the possibility of multiple different impact points, the targeting system guides the impact ram along a ram path to strike at the same impact point. By further example, the impact tool of the disclosed embodiments includes an impact force control system, which is configured to provide a precise amount of impact force on the blade. The impact force control system enables repeatability of the impact force from one strike to another on the same blade, as well as from one blade to another. Thus, the impact force control system may prevent the possibility of exceeding an upper threshold for the impact force, while maximizing the impact force to decrease the number of strikes and installation time for each blade. Although the disclosed impact tool may be used to install blades in a variety of turbines and compressors, the following discussion presents an embodiment of an impact tool that may be used in the context of power plants and steam turbines.

Figure 1:
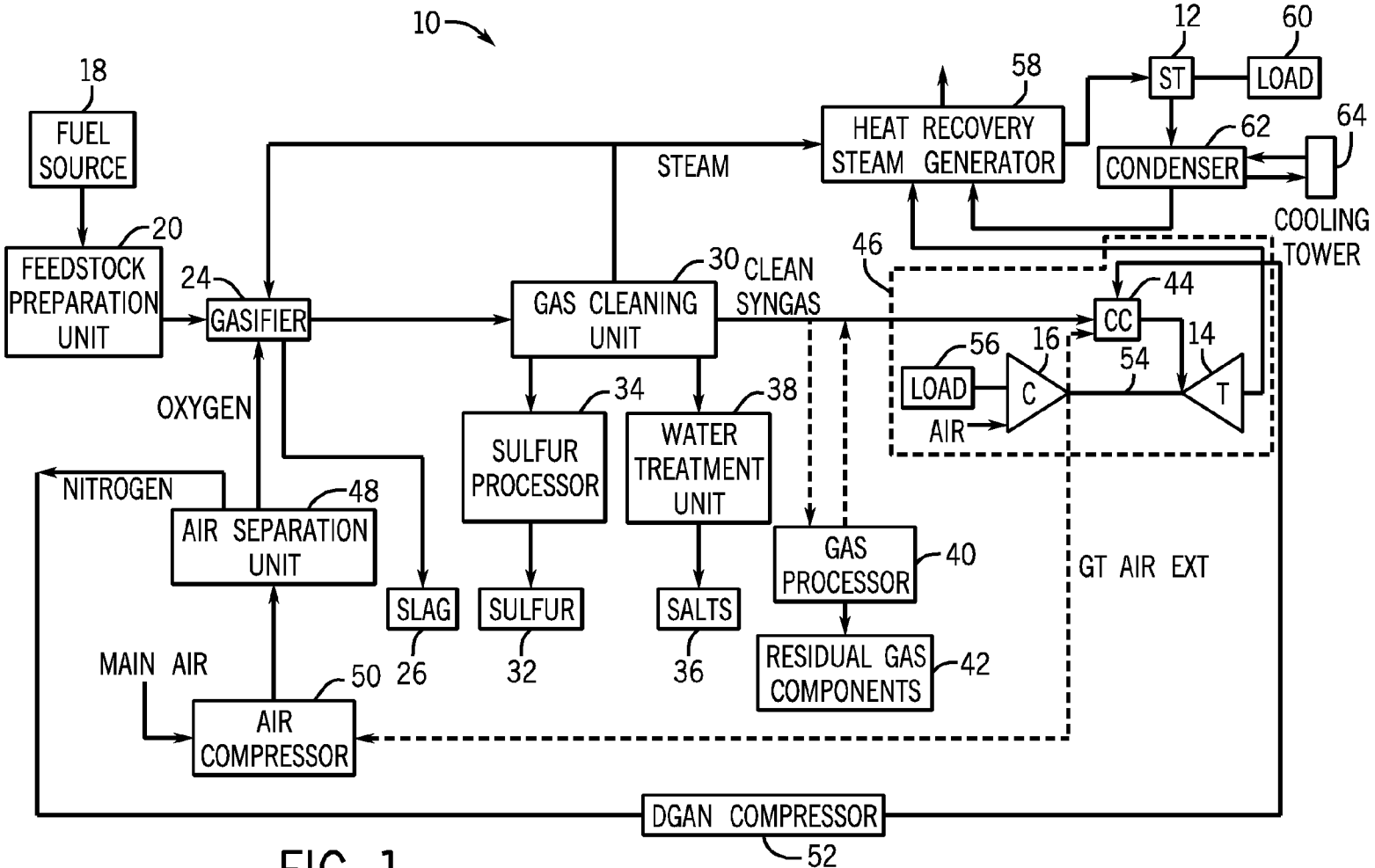
FIG. 1 is a block diagram of an embodiment of an integrated gasification combined cycle (IGCC) power plant having a gas turbine and a steam turbine.

With the foregoing in mind, FIG. 1 depicts an embodiment of an integrated gasification combined cycle (IGCC) power plant 10 that may include a steam turbine 12, a gas turbine 14, and a compressor 16. The steam turbine 12, gas turbine 14, and compressor 16 may each require the installation of blades as described in more detail below with respect to FIG. 3. For descriptive purposes, the operation of the plant 10 including the steam turbine 12, gas turbine 14, and compressor 16 is as follows.

A fuel source 18 may be passed to a feedstock preparation unit 20. The feedstock prepared by the feedstock preparation unit 20 may be passed to the gasifier 24. The gasifier 24 may convert the feedstock into syngas, e.g., a combination of carbon monoxide and hydrogen. The combustion reaction in the gasifier 24 may include introducing oxygen to the char and residue gases. The char and residue gases may react with the oxygen to form carbon dioxide and carbon monoxide, which provides heat for the subsequent gasification reactions. The gasifier 24 utilizes steam and oxygen to allow some of the feedstock to be burned to produce carbon monoxide and energy, which may drive a second reaction that converts further feedstock to hydrogen and additional carbon dioxide. In this way, a resultant gas may be manufactured by the gasifier 24. The resultant gas may include approximately 85% of carbon monoxide and hydrogen, as well as $CH_4$, HCl, HF, COS, $NH_3$, HCN, and $H_2S$ (based on the sulfur content of the feedstock). This resultant gas may be termed "untreated syngas." The gasifier 24 may also generate waste, such as a slag 26, which may be a wet ash material.

A gas cleaning unit 30 may be utilized to treat the untreated syngas. The gas cleaning unit 30 may scrub the untreated syngas to remove the HCl, HF, COS, HCN, and $H_2S$ from the untreated syngas, which may include the separation of $H_2S$ by an acid gas removal process. Elemental sulfur 32 may by recovered by the sulfur processor 34 from the $H_2S$. Furthermore, the gas cleaning unit 30 may separate salts 36 from the untreated syngas via a water treatment unit 38, which may utilize water purification techniques to generate usable salts 36 from the untreated syngas. Subsequently, a treated syngas may be generated from the gas cleaning unit 30.

A gas processor 40 may be utilized to remove residual gas components 42 from the treated syngas, such as ammonia and methane, as well as methanol or other residual chemicals. However, removal of residual gas components 42 from the treated syngas is optional since the treated syngas may be utilized as a fuel even when containing the residual gas components 42 (e.g., tail gas). This treated syngas may be directed into a combustor 44 (e.g., a combustion chamber) of a gas turbine engine 46 as combustible fuel. The gas turbine engine 46 may include components such as gas turbine 16 and a compressor 16 that may require the installation of a set of turbine blades as described in more detail with respect to FIG. 3 below.

The IGCC system 10 may further include an ASU 48. The ASU 48 may separate air into component gases using, for example, distillation techniques. The ASU 48 may separate oxygen from the air supplied to it from a supplemental air compressor 50 and may transfer the separated oxygen to the gasifier 24. Additionally, the ASU 48 may direct separated nitrogen to a diluent nitrogen (DGAN) compressor 52. The DGAN compressor 52 may compress the nitrogen received from the ASU 48 at least to pressure levels equal to those in the combustor 44, so as to not interfere with proper combustion of the syngas. Thus, once the DGAN compressor 52 has adequately compressed the nitrogen to an adequate level, the DGAN compressor 52 may direct the compressed nitrogen to the combustor 44 of the gas turbine engine 46.

As described above, the compressed nitrogen may be transferred from the DGAN compressor 52 to the combustor 44 of the gas turbine engine 46. The gas turbine engine 46 may include a turbine 14, a drive shaft 54, and a compressor 16, as well as the combustor 44. The combustor 44 may receive fuel, such as the syngas, which may be injected under pressure from fuel nozzles. This fuel may be mixed with compressed air as well as compressed nitrogen from the DGAN compressor 52 and combusted within the combustor 44. This combustion may create hot pressurized exhaust gases. The combustor 44 may direct the exhaust gases towards an exhaust outlet of the turbine 14. As the exhaust gases from the combustor 44 pass through the turbine 14, the exhaust gases may force turbine blades in the turbine 14 to rotate the drive shaft 54 along an axis of the gas turbine engine 46. As illustrated, the drive shaft 54 may be connected to various components of the gas turbine engine 46, including the compressor 16.

The drive shaft 54 may connect the turbine 14 to the compressor 16 to form a rotor. The compressor 16 may include blades (i.e., buckets) coupled to the drive shaft 54. Thus, rotation of turbine blades in the turbine 14 may cause the drive shaft 54 connecting the turbine 14 to the compressor 16 to rotate blades within the compressor 14. The rotation of blades in the compressor 14 causes the compressor 14 to compress air received via an air intake in the compressor 14. The compressed air may then be fed to the combustor 44 and mixed with fuel and compressed nitrogen to allow for higher efficiency combustion. The drive shaft 54 may also be connected to a load 56, which may be a stationary load, such as an electrical generator, for producing electrical power in a power plant. Indeed, the load 56 may be any suitable device that is powered by the rotational output of the gas turbine engine 46.

The IGCC system 10 also may include a steam turbine engine 12 and a heat recovery steam generation (HRSG) system 58. Steam may enter the steam turbine engine 12 and expand as it moves through the turbine, causing a set of stages of turbine blades to rotate around an axis. The installation of turbine blades in the stages is described in more detail with respect to FIG. 3 below. The rotation energy of the steam turbine engine 12 may be used to drive a second load 60, such as an electrical generator for generating electrical power. However, both the first and second loads 56, 60 may be other types of loads capable of being driven by the gas turbine engine 46 and the steam turbine engine 12, respectively. In addition, although the gas turbine engine 46 and the steam turbine engine 12 may drive separate loads 56, 60, as shown in the illustrated embodiment, the gas turbine engine 46 and the steam turbine engine 12 may also be utilized in tandem to drive a single load via a single shaft. The specific configuration of the steam turbine engine 12, as well as the gas turbine engine 46, may be implementation-specific and may include any combination of sections. One configuration of the steam turbine engine 12 is described in more detail below with respect to FIG. 2.

Heated exhaust gas from the gas turbine engine 46 may be directed into the HRSG 58 and used to heat water and produce steam used to power the steam turbine engine 12. Exhaust from the steam turbine engine 12 may be directed into a condenser 62. The condenser 62 may utilize a cooling tower 64 to exchange heated water for chilled water. In particular, the cooling tower 64 may provide cool water to the condenser 62 to aid in condensing the steam directed into the condenser 62 from the steam turbine engine 12. Condensate from the condenser 62 may, in turn, be directed into the HRSG 58. Again, exhaust from the gas turbine engine 46 may also be directed into the HRSG 58 to heat the water from the condenser 62 and produce steam.

As such, in combined cycle systems such as the IGCC system 10, hot exhaust may flow from the gas turbine engine 46 to the HRSG 58, where it may be used to generate high-pressure, high-temperature steam. The steam produced by the HRSG 58 may then be passed through the steam turbine engine 12 for power generation.

Figure 2:
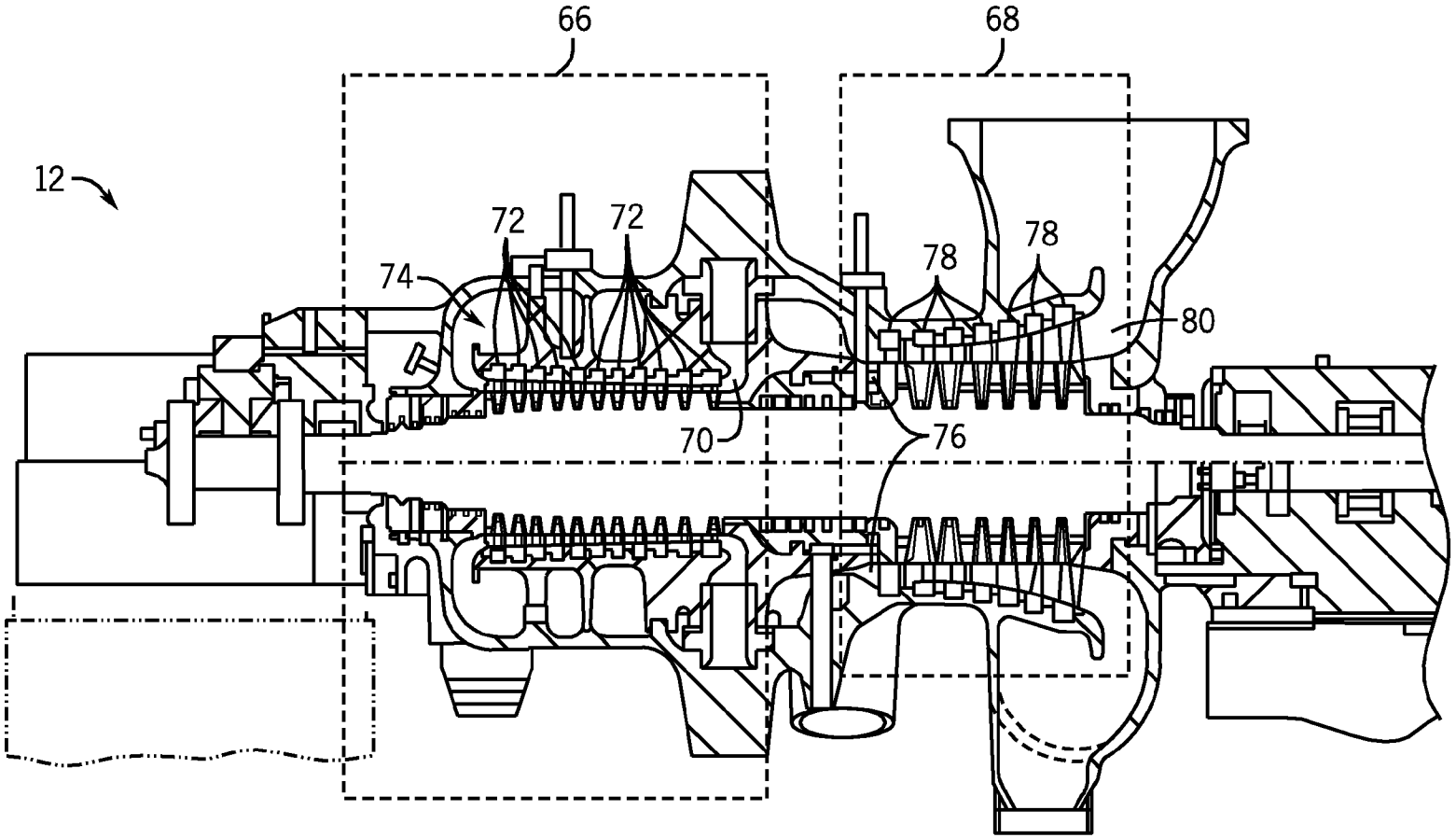
FIG. 2 is a cross-section of an embodiment of a steam turbine having multiple turbine stages.

FIG. 2 is cross-sectional side view of an embodiment of a steam turbine 12 having an opposed flow high-pressure section 66 and an intermediate-pressure section 68. During operation, a high-pressure steam inlet 70 receives high-pressure steam from the HRSG 58 and routes the high-pressure steam through high-pressure turbine stages 72, driving turbine blades to cause rotation of a common rotor shaft of the steam turbine 12. The assembly of the blades into each turbine stage 72 is described in more detail with respect to FIG. 3 below. The high-pressure steam exits the high-pressure section 66 of the steam turbine 12 through a high-pressure steam outlet 74. In certain embodiments, the high-pressure steam may be directed back to the HRSG 58 for further superheating and ultimate use in the intermediate-pressure section 68 of the steam turbine 12.

Similarly, the intermediate-pressure steam inlet 76 receives the intermediate-pressure steam from the HRSG 32 and routes the intermediate-pressure steam through intermediate-pressure turbine stages 78, driving blades to cause rotation of the common rotor shaft of the steam turbine 12. The assembly of the blades into each turbine stage 78 is described in more detail with respect to FIG. 3 below. The intermediate-pressure steam exits the intermediate-pressure section 68 of the steam turbine 12 through an intermediate-pressure steam outlet 80. In certain embodiments, the steam turbine 12 may also include a low-pressure section, and the intermediate-pressure steam may be directed into a low-pressure section of the steam turbine 12.

Figure 3:
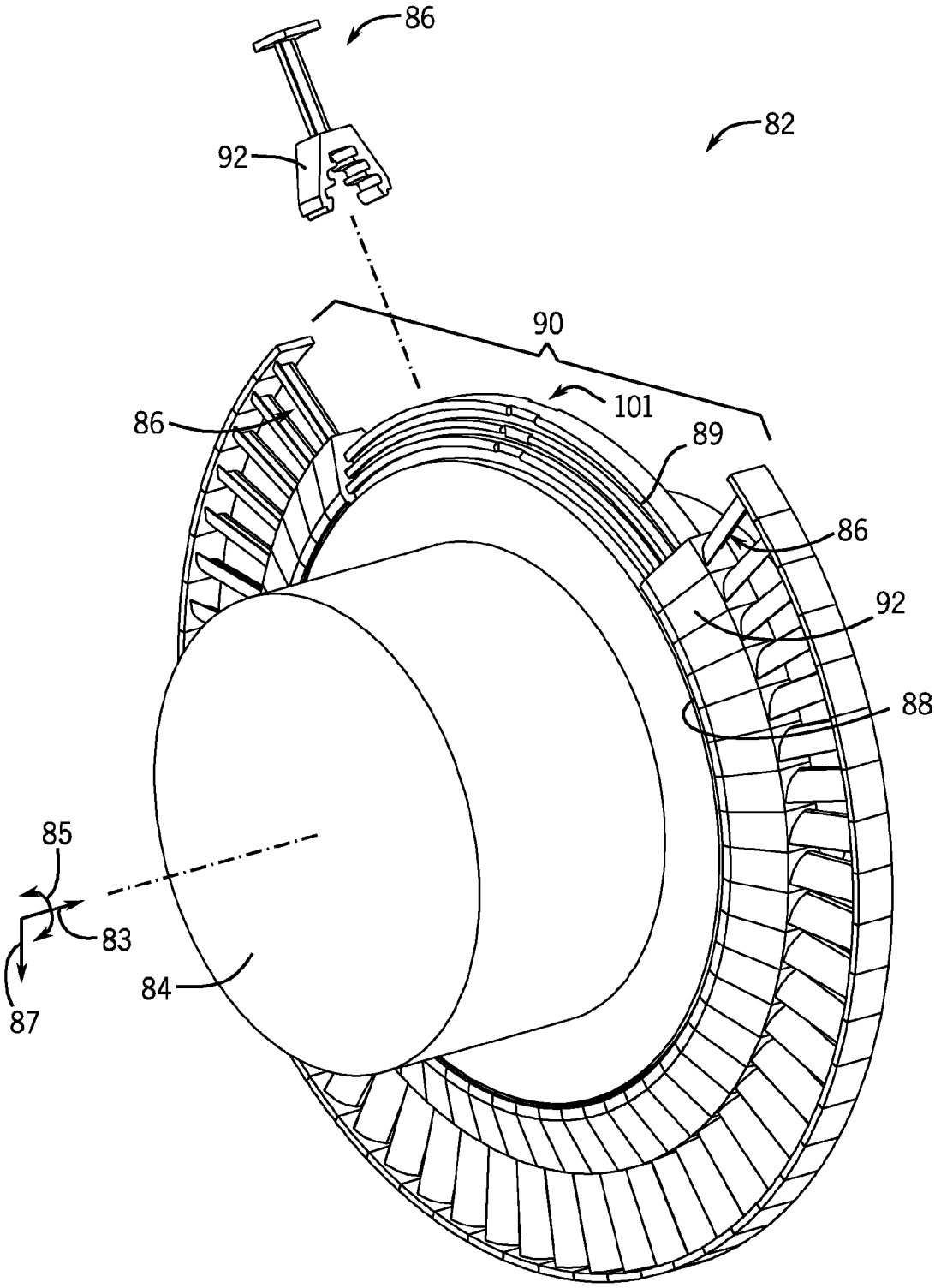
FIG. 3 is a perspective view of an embodiment of a turbine stage partially assembled during a blade installation process.

FIG. 3 is a perspective view of a single turbine stage 82 having a shaft 84 with a plurality of blades 86 partially installed onto a rotor disk 88. In certain embodiments, the turbine stage 82 may correspond to a stage of the steam turbine 12, the gas turbine 14, the compressor 16, or another rotary machine having segmented blades 86. For example, the turbine stage 82 may be designed for one of the turbine stages 72 or 78 described with respect to FIG. 2 above. Thus, the geometry, material construction, and configuration may vary depending on the particular application.

In certain embodiments, the blades 86 may be installed circumferentially about the rotor disk 88 relative to a central longitudinal axis or axial direction 83. For example, the blades 86 may be installed in a circumferential direction 85 along the circumference of the rotor disk 88, while a final locking blade (FIG. 4) may be installed in a radial direction 87 toward the rotor disk 88 and the axis 83. As illustrated in FIG. 3, the blades 86 are circumferentially installed into a circumferential track 89 along the rotor disk 88, with the exception of an empty portion 90. The empty portion 90 may be filled with additional blades 86, e.g., by inserting each blade 86 in the circumferential direction 85 (e.g., tangential) along the circumferential track 89, until the empty portion 90 is reduced to a final lock blade slot. Each of the blades 86 in the turbine stage 82 may be an integrally covered bucket (ICB).

Figure 4:
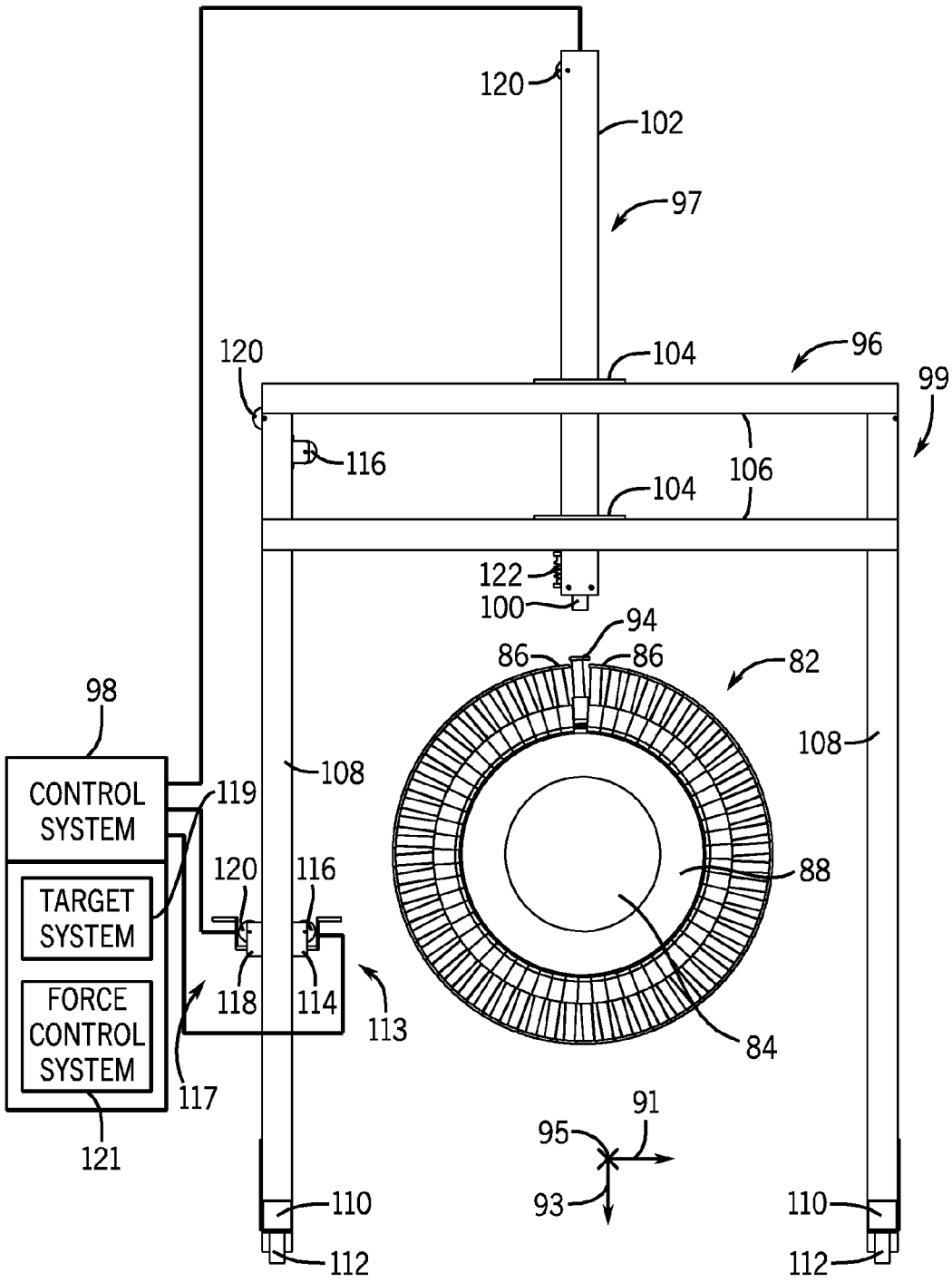
FIG. 4 is a front view of an embodiment of an impact tool having a vertical guide raised to a position adjacent the turbine stage of FIG. 3.

In certain embodiments, each blade (e.g., ICB 86) includes a circumferential entry dovetail 92, which mates with a mating dovetail structure in the circumferential track 89. Thus, each ICB 86 may enter along a notched section 101 of the circumferential track 89 and slide circumferentially along the rotor disk 88 in the circumferential track 89 to incrementally fill the track 89. The last blade to be assembled into the rotor disk 88 is a lock blade 94 as shown in FIG. 4 and described in further detail below. The final lock blade 94, however, does not enter the rotor disk 88 in the circumferential direction 85, but rather the lock blade 94 enters the rotor disk 88 in the radial direction 87 as shown in FIG. 4.

FIG. 4 is a schematic of an embodiment of an impact tool 96 configured to impact the lock blade 94 in the radial direction 87 into the turbine stage 82 circumferentially between blades 86 along the track 89 of the rotor disk 88. As illustrated, the turbine stage 82 has the blades 86 circumferentially installed in the track 89 and the lock blade 94 partially inserted in the radial direction 87 prior to impact into the rotor disk 88 by the impact tool 96. In context of FIGS. 4-9, the X-axis or first horizontal direction (along the page) may correspond to arrow 91, the Y-axis or vertical direction may correspond to arrow 93, and the Z-axis or second horizontal direction (perpendicular to the page) may correspond to arrow 95. Thus, any discussion of horizontal and vertical directions generally correspond to these axes 91, 93, and 95. In the illustrated embodiment, the impact tool 96 includes an impact ram assembly 97 coupled to a frame 99 vertically above the turbine stage 82. In particular, the frame 99 includes a plurality of support structures to hold the impact ram assembly 97 in a stable position above the turbine stage 82, thereby facilitating targeting of an impact force onto the lock blade 94. The impact tool 96 also includes a control system 98 configured to control operation of the impact ram assembly 97 to provide a precise targeting position and impact force onto the lock blade 94. The impacting of the lock blade 94 into its final, locked position may cause a circumferential compressive force with respect to adjoining blades 86 and complete the assembly of all of the blades 86 of turbine stage 82.

In the illustrated embodiment, the impact ram assembly 97 includes an impact ram 100 coupled to a guide 102 (e.g., vertical guide including a vertical ram path). For example, the vertical guide 102 may be a hollow tube (e.g., square or cylindrical tube) or a conduit at least substantially or completely surrounding the impact ram 100, and thus restricting movement of the impact ram 100 to the vertical direction 93 (i.e., generally no movement in the directions 91 and 95). The example hollow tube or conduit may thus include a vertical passage defining a vertical ram path. In the illustrated embodiment, vertical guide 102 is linear and thus includes a ram path that has a linear path. By further example, the vertical guide 102 may include 2 or 3 walls (e.g., a channel) extending along the impact ram 100 in the vertical direction 93, while restricting movement of the impact ram 100 to the vertical direction 94. In the illustrated embodiment, the impact ram 100 may be gravity driven in the downward vertical direction 93. However, other embodiments of the impact ram assembly 97 may include a drive (e.g., electrical motor, hydraulic drive, or pneumatic drive) configured to force the impact ram 100 in the vertical direction 93.

As noted above, the impact ram assembly 97 is supported by the frame 99, which includes upper and lower guide plates 104, upper and lower cross-members 106, opposite left and right vertical legs 108, and opposite left and right horizontal feet 110 having lockable wheels 112. Altogether, the frame 99 surrounds the turbine stage 82 on opposite left and right sides as wells as vertically overhead, where the frame 99 holds the impact ram assembly 97. The impact ram assembly 97 may be precisely horizontally centered over the lock blade 94 by unlocking the wheels 112, horizontally moving the frame 99, and then locking the wheels 112. In certain embodiments, the lockable wheels 112 are powered wheels, such as motorized wheels having an electric motor, a hydraulic drive, or a pneumatic drive. Accordingly, the powered wheels 112 may facilitate movement of the impact tool 96 to provide precise targeting of the impact ram 100 relative to the lock blade 94.

The impact ram assembly 97 also may be precisely vertically positioned over the lock blade 94 by vertically moving the guide 102 relative to the frame 99. For example, the impact tool 96 may include a vertical positioning system 113 (e.g., guide lift or guide positioner) coupled to the vertical guide 102, wherein the vertical positioning system 113 may include a manual drive or an automatic drive. The vertical positioning system 113 may thus move the vertical guide along a vertical guide path between a lowered guide position and a raised (e.g. upper) guide position. In the illustrated embodiment, vertical positioning system 113 defines a guide path that is linear and that is parallel to the linear ram path defined by the vertical guide 102. In the illustrated embodiment, the vertical positioning system 113 includes a winch 114 having a cable and pulley system 116, which is coupled to the vertical guide 102. The winch 114 may include a manual drive (e.g., rotatable wheel) and/or an automatic drive (e.g., electric motor, hydraulic drive, or pneumatic drive). In some embodiments, the vertical positioning system 113 may include a rack and pinion system, a hydraulic lift, a pneumatic lift, a worm gear system, a chain and sprocket system, or a combination thereof. As discussed below, the vertical positioning system 113 enables controlled upward and downward vertical movement of the vertical guide 102 along the vertical axis 93 to facilitate precise targeting of the impact ram 100 relative to the lock blade 94. It is to be understood that while the illustrated embodiments show a vertical positioning system, the disclosed techniques may be used to build a guide positioner that may be angled in relation to a vertical axis. The guide positioner may then move the guide along a guide path relative to the frame. Indeed, the disclosed techniques may be used to build a guide positioner in any orientation, including a horizontal orientation.

The illustrated impact ram assembly 97 also includes a vertical lift system 117 (e.g., ram lift or ram positioner) removably coupled to the impact ram 100, wherein the vertical lift system 117 may include a manual drive or an automatic drive. The vertical lift system 117 may guide a ram from a lowered impact position to a variable raised position (i.e., retracted position) by using a control system 98. The control system 98 may be separate or part of the vertical lift system 117. In the illustrated embodiment, the vertical lift system 117 includes a winch 118 having a cable and pulley system 120, which is removably coupled to the impact ram 100. The winch 118 may include a manual drive (e.g., rotatable wheel) and/or an automatic drive (e.g., electric motor, hydraulic drive, or pneumatic drive). In some embodiments, the vertical lift system 117 may include a rack and pinion system, a hydraulic lift, a pneumatic lift, a worm gear system, a chain and sprocket system, or a combination thereof. As discussed below, the vertical lift system 117 enables controlled vertical movement of the impact ram 100 along the vertical axis 93 to prepare the impact ram 100 for a gravity-driven drop against the lock blade 94. For example, the vertical lift system 117 may increase or decrease a vertical height of the impact ram 100 relative to the lock blade 94 to control the impact force. The vertical lift system 117 may then release the impact ram 100 to enable gravity to drive the impact ram 100 vertically downward against the lock blade 94. In other embodiments, the impact ram assembly 97 may be positioned horizontally or in a different orientation, and may be driven by another drive mechanism to provide the impact force. However, the gravity-driven impact ram 100 substantially simplifies the construction of the impact tool 96, while also enabling repeatability of the impact force against the lock blade 94.

The control system 98 is configured to control one or more aspects of the targeting and impact force of the impact ram 100 against the lock blade 94. In certain embodiments, the control system 98 includes a targeting system 119 and an impact force control system 121. The targeting system 119 may be coupled to (e.g., communicate control signals and receive feedback from) the vertical positioning system 113, the vertical lift system 117, and the powered wheels 112. Accordingly, the targeting system 119 may precisely adjust the horizontal and vertical position of the vertical guide 102 of the impact ram assembly 97, thereby précising targeting the impact point between the impact ram 100 and the lock blade 94. For example, the targeting system 119 may command the powered wheels 112 to move the impact tool 96 in the first and/or second horizontal directions 91 and 95 until the impact ram assembly 97 is horizontally centered above the lock blade 94. The targeting system 119 also may command the vertical positioning system 113 to raise or lower the vertical guide 102 until the guide 102 is vertically proximate the lock blade 94. The impact force control system 121 may be coupled to (e.g., communicate control signals and receive feedback from) the vertical positioning system 113 and the vertical lift system 117. For example, the impact force control system 121 may command the vertical lift system 117 to raise or lower the impact ram 100 relative to the guide 102 and the lock blade 94, thereby increasing or decreasing the gravity-driven impact force associated with the impact ram 100. Accordingly, the impact force control system 121 can be configured to adjust the height of the impact ram 100 to a first position. The impact ram 100 may then be released and impact at a second position, the second position being offset from the first position by the adjusted height. Furthermore, the control system 98 may include a trigger signal or actuation command configured to release the impact ram 100 from the vertical lift system 117, e.g., disengage an electromagnet (FIG. 5) holding the impact ram 100. However, the impact tool 96 may include other release mechanisms between the impact ram 100 and the vertical lift system 117.

As illustrated in FIG. 4, the impact tool 96 has the vertical guide 102 positioned in a vertically raised or high position, i.e., the topmost vertical position that may be achieved by moving the vertical guide 102 upwards along the vertical axis 93 until a spring 122 assembly contacts the lower cross-member 106, thereby blocking further upward motion of the vertical guide 102. Moving the vertical guide 102 to the high position allows for increased vertical clearance, so that the impact tool 96 carrying the ram 100 may be more easily moved to a target position directly over the lock blade 94. As discussed above, the wheels 112 enable movement of the impact tool 96 along the first and second horizontal axes 91 and 95, while the vertical guide 102 moves the impact ram 100 along the vertical axis 93 until the ram 100 is centered and in contact with the lock blade 94 as depicted in FIG. 5.

Figure 5:
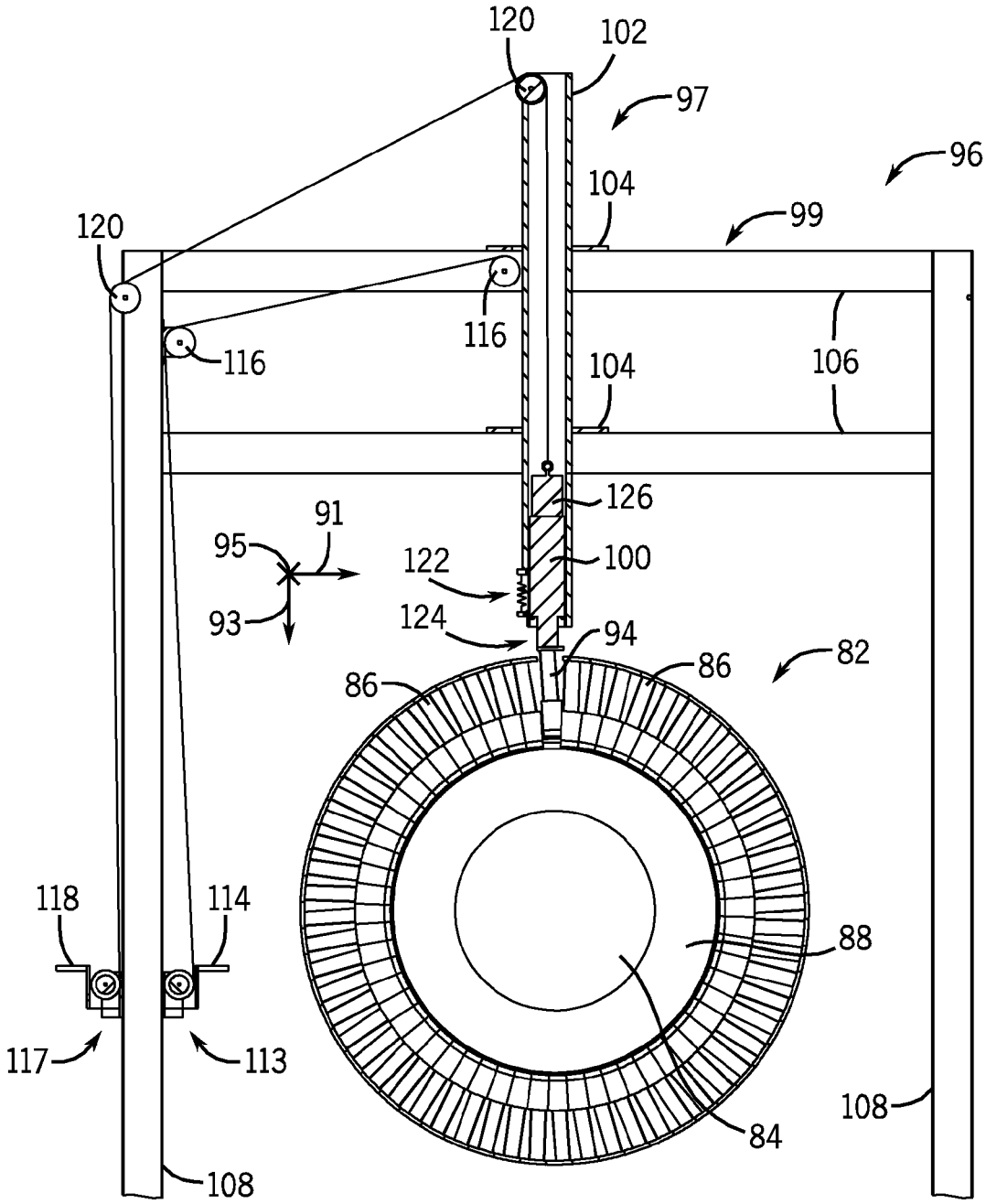
FIG. 5 is a front cross-section of an embodiment of the impact tool of FIG. 4, illustrating a ram in a lowered position.

FIG. 5 is a partial cross-sectional view of an embodiment of the impact tool 96 having the ram 100 targeted into a final target position. Once the impact tool 96 has been targeted such that the ram 100 is directly overhead of the lock blade 94, then the impact tool's 96 wheels 112 may be locked and the vertical guide 102 may be targeted (e.g., lowered or raised). The winch 114 may be used to target the vertical guide 102, so that the ram 100 may physically contact the top cover of the lock blade 94. Very precise targeting may be possible because the precise point of impact on the lock blade 94 will be the contact point where the ram's 100 impact head (i.e., protrusion) 124 is physically contacting the lock blade 94. Other targeting methods may be used, for example, a laser disposed on the wave guide may point a laser beam at the impact point on the lock blade 94. A final target position may therefore include the impact tool 96 overhead of the lock blade 94 and the vertical guide 102 lowered so that the ram's 100 impact head 124 is physically contacting the lock blade 94.

As illustrated in FIG. 5, the vertical lift system 117 includes an electromagnet 126, which may be raised or lowered by using the winch 118 connected to the electromagnet 126 through the cable and pulley system 120. Once the electromagnet 126 is lowered to contact the ram 100, the electromagnet 126 may be electromagnetically coupled to the ram 100 through an electrical power source such as a 12 volt battery. The electromagnet 126 is sized such that its electromagnetic force is sufficiently strong to couple with the ram 100 and allow the ram 100 to be raised along with the electromagnet 126. In other embodiments, the electromagnet 126 may be raised through a rack and pinion system, a hydraulic system, a pneumatic system, a worm gear system, a chain and sprocket system, or a combination thereof.

Figure 6:
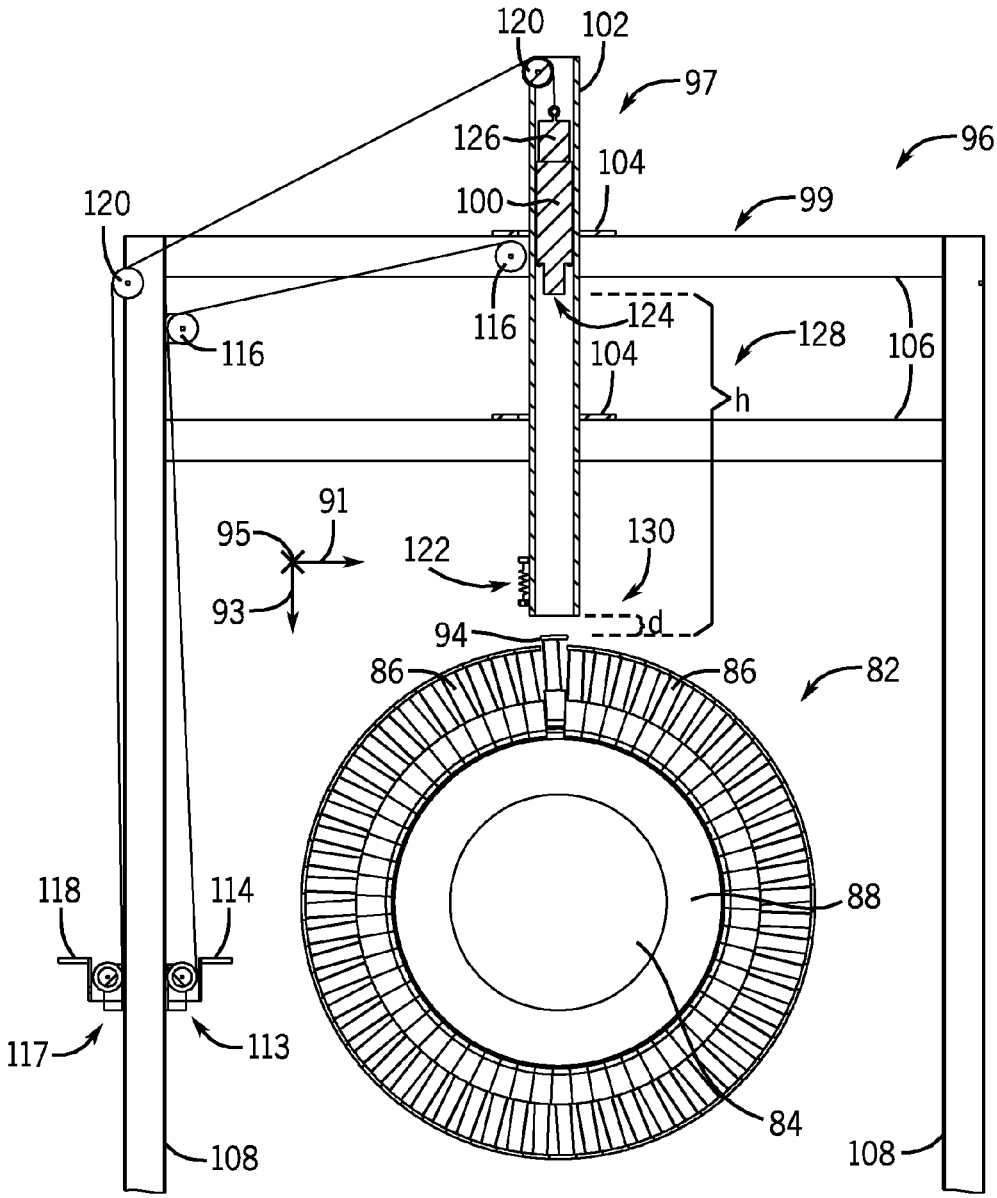
FIG. 6 is a front cross-section of an embodiment of the impact tool of FIG. 4, illustrating the ram in a raised position.

FIG. 6 is a partial cross-sectional view of an embodiment of the impact tool 96 having the electromagnet 126 electromagnetically coupled to the ram 100 and raised to a high position selected to control the impact force on the lock blade 94. More specifically, FIG. 6 depicts both the electromagnet 126 and the ram 100 in a vertically raised position, such that the ram's 100 impact head 124 is at a height h 128 from the top of the lock blade 94. The height h 128 may be chosen so that when the ram 100 is dropped, the combination of the height h 128 and the ram's 100 weight will result in an impact having enough force to drive the lock blade 94 further into the rotor ring 88, but not excessive force so as to cause damage to the lock blade 94 or any other turbine stage 82 component.

In certain embodiments, the sides of the vertical guide 102 may have openings that allow for a visual evaluation of the position of the ram 100. Such visual indicia may include a series of height markings inscribed by each opening to allow an operator to determine the height of the ram 100. Each mark may represent a different magnitude of the impact force. Additional markings may be may be inscribed on the impact tool 96 or provided as part of an operations manual that detail, for example, the amount of impact force that may result from releasing the ram 100 from a certain height. Table 1 below shows an example of an impact guide that may be used to calculate the amount of impact force (i.e., impulse) corresponding to the lift height of an example ram 100.

TABLE 1

| Impact Guide | | | |
|---|---|---|---|
| Lift Height (inches) | Velocity Final (ft/s) | Impulse (ft * lbs/s) | Relative Bucket Size |
| 0 | 0.00 | 0.0 | Small |
| 3 | 4.00 | 240.0 | Small |
| 6 | 5.66 | 339.4 | Small |
| 12 | 8.00 | 480.0 | Medium |
| 18 | 9.80 | 587.9 | Medium |
| 24 | 11.31 | 678.8 | Medium |
| 30 | 12.65 | 758.9 | Medium |
| 36 | 13.86 | 831.4 | Medium |
| 42 | 14.97 | 898.0 | Large |
| 48 | 16.00 | 960.0 | Large |
| 54 | 16.97 | 1018.2 | Large |
| 60 | 17.89 | 1073.3 | Large |

An operator may refer to Table 1 above and quickly calculate a vertical height to raise the ram 100 based on, for example, the size of the target bucket, the final velocity that may be required, or the impulse (i.e., impact force) that may be required. Once the ram 100 has been raised to the appropriate height, for example, through user input (i.e., operator action), the ram 100 may then be decoupled and released by turning off the electromagnet 126. In one embodiment, such as the one depicted in FIG. 6, gravity will cause the ram 100 to accelerate and impact into the lock blade 94. In certain embodiments, other forces such as those generated by compressed air, hydraulics, or a spring, among others, may be adjusted and controlled by the control system 98 to impact the ram 100 into the lock blade 94 with the appropriate amount of force. Depending on the application, the impact tool 96 may provide 1 to 100, 1 to 50, 1 to 10, or 1 to 5 iterations of gravity-driven impact of the ram 100 against the lock blade 94 to fully secure the lock blade 94 into its final position in the rotor disk 88.

As further illustrated in FIG. 6, the vertical guide 102 may be positioned at an offset distance d 130 relative to the top surface (i.e., cover) of the lock blade 94. The distance d 130 may be adjusted as part of the targeting process by moving the guide 102 up or down, so that the distance d 130 does not result in a dry fire situation. A dry fire situation may be defined as an impact of the ram 100 against the lower surface of the guide 102 instead of impacting the lock blade 94. A dry fire may result, for example, if the guide 102 is raised such that the distance d 130 is greater than the length of the ram's 100 impact head 124. Accordingly, the guide 102 may be lowered during targeting so that both the impact head 124 and the lower surface of the guide 102 are physically contacting the lock blade 94, and such that the impact head 124 is at least partially or entirely retracted into the guide 102. A safety spring 122 may also be provided to dampen the effect of a dry fire as described in more detail with respect to FIG. 8 below.

Figure 7:
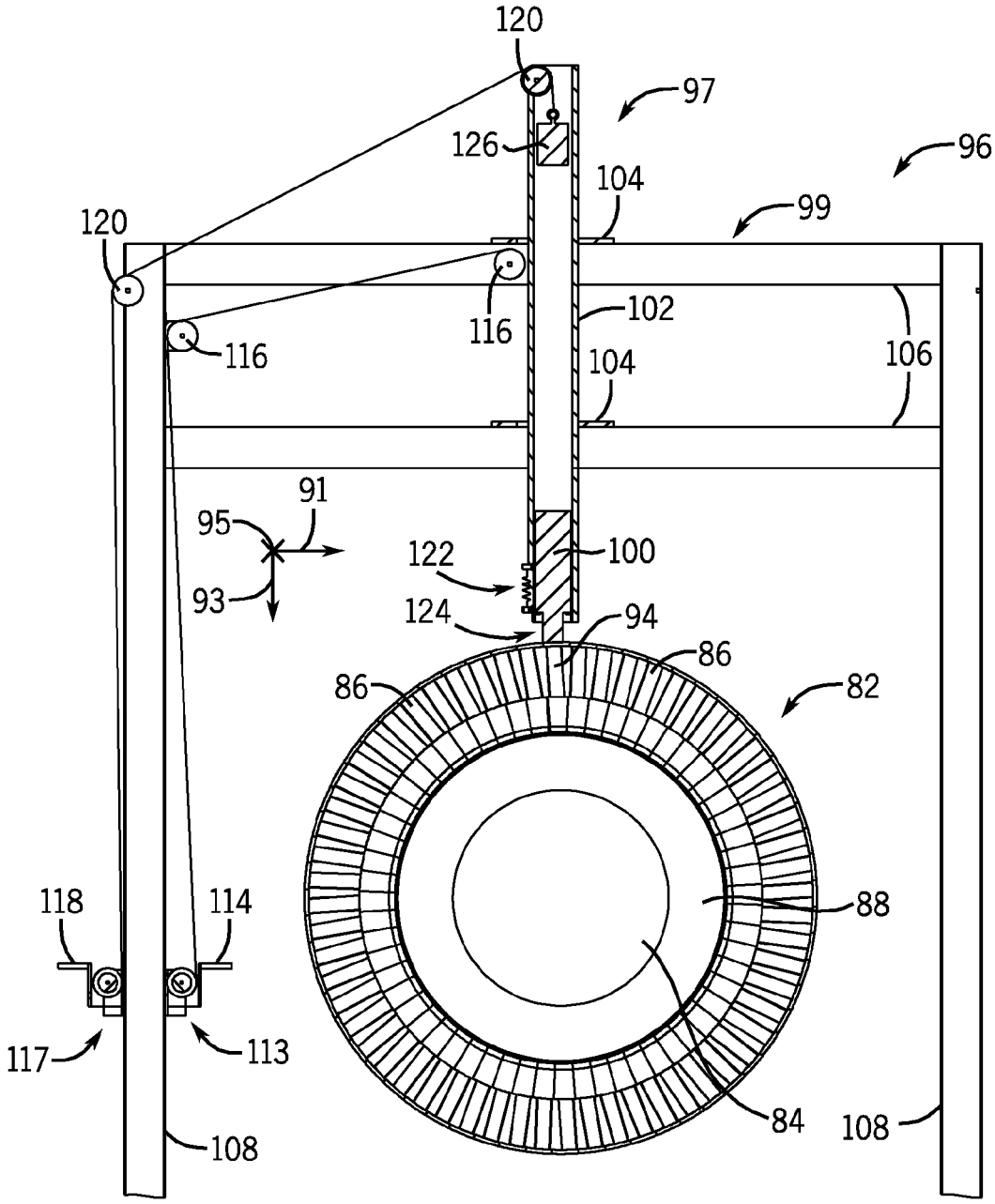
FIG. 7 is a front cross-section of an embodiment of the impact tool of FIG. 4, illustrating the ram in an impact position.

FIG. 7 is a partial cross-sectional view of an embodiment of the impact tool 96 having the ram 100 disengaged and vertically dropped from the electromagnet 126 and vertically impacting against the lock blade 94. In particular, the ram's 100 impact head 124 is shown resting on the top surface of the lock blade 94 after driving the lock blade 94 into its final, locked position. As mentioned above, the impact tool 96 may apply one or more iterations of targeting and impacting the ram 100 against the lock blade 94 to vertically drive the lock blade 94 into its final, locked positioned. The final, locked position has the lock blade 94 fully inserted into the rotor disk 88, such that the top surface of the lock blade 94 is at approximately the same height as the top surface of all other blades 86. Embodiments of the impact tool 96 may be used to drastically reduce the number of impacts and the time required to drive the lock blade 94 into its final, locked position. By using the impact tool 96 rather than a hand held sledge hammer, the lock blade 94 impacting process may be reduced from hundreds of sledge hammer impacts taking place over several hours to less than approximately 5, 10, 15, or 20 tool impacts taking place in a time span of less than approximately 10, 15, 20, 25, or 30 minutes. As appreciated, the number of tool impacts varies depending on the particular application.

Figure 8:
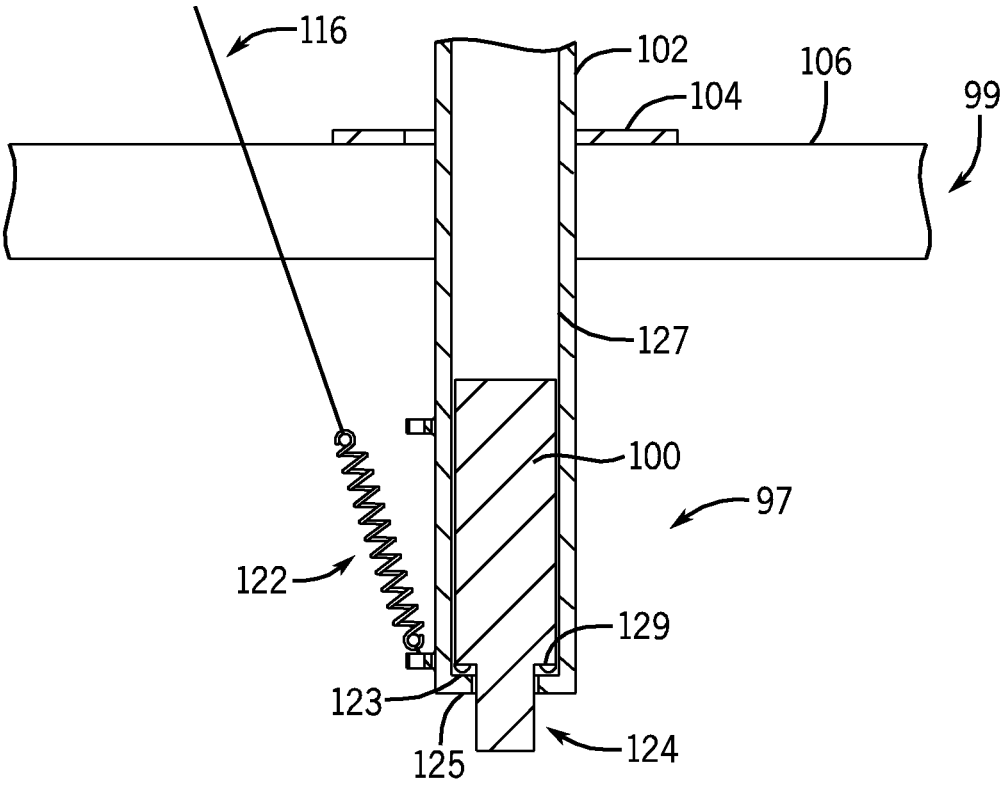
FIG. 8 is a partial cross-section of an embodiment of the impact tool of FIG. 4, illustrating a guide, a ram and a spring.

FIG. 8 is a partial cross-sectional view of an embodiment of the impact tool 96, illustrating a close-up of a lower portion of the impact ram assembly 97. In particular, the ram 100 is shown resting against a lower interior surface 123 (i.e., ram catch) of the guide 102. A section 129 of the ram (i.e., ram abutment surface) contacts the lower interior surface 103 of the guide 102. In this resting position, the ram's 100 impact head 124 protrudes through an opening 125 in the lower interior surface 123 of the guide 102. In the embodiment depicted in FIG. 8, the guide 102 may be constructed out of square metal tubing, so as to completely enclose the ram 100 inside a rectangular channel 127. The ram 100 may slide up and down the inner rectangular channel 127 of the guide 102, because the inner rectangular channel 127 may be constructed so that its dimensions (i.e., width and length) are slightly larger than the width and length of the ram 102. The height of the guide 102 may be selected to allow the ram 100 to be raised up the guide 102 to a level sufficiently high to allow the ram 100 to fall with a force strong enough to be useful in impacting a target (e.g., a lock blade 94). The vertical guide 102 may be replaced with vertical guides 102 of different heights as appropriate for specific applications, for example, taller vertical guides for use in high impact force applications and shorter vertical guides for use in low impact force applications. The ram 100 inside of the guide 102 may also be replaced with a different ram 100, i.e., a. ram 100 that is longer or shorter, that has a different weight, that has a different type or shape on the impact head 124, that is made of a different material (e.g., metal, plastic, wood), among others. The flexibility offered by replacing the vertical guide 102 and the ram 100 allows for a wide use of the impact tool 96 in many types of impacting processes.

As further illustrated in FIG. 8, the spring 122 may be used to dampen the impact force of the ram 100 in cases of dry firing of the ram 100. The lower end of the spring 122 may be coupled near the lower surface 123 of the guide 102 and the upper end of the spring 118 may be coupled to the cable and pulley system 116. Accordingly, the ram's 100 impact on the lower surface 123 of the guide 102 may be dampened by the spring 122, thereby substantially reducing undesirable forces on the guide 102 and preventing damage to the impact tool 96. The spring 122 may have a spring force selected based on the expected impact force of the ram 100, e.g., based on the weight of the ram 100 and the length of the guide 102. Accordingly, the spring 122 may be chosen to accommodate different types of rams 100 and to protect from different dry fire forces.

Figure 9:
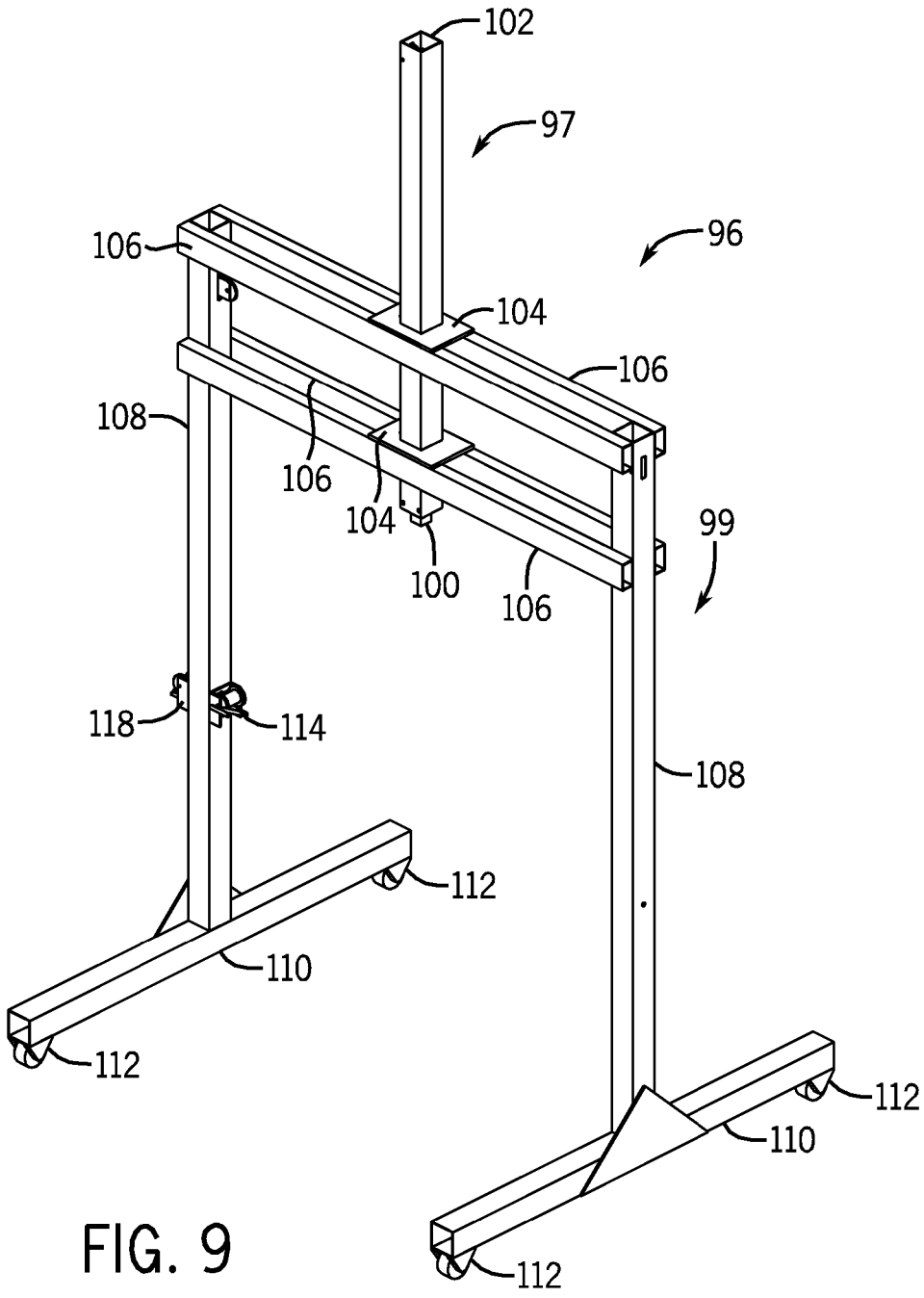
FIG. 9 is a perspective view of an embodiment of the impact tool of FIG. 4; and, FIG. 10 is a flowchart of an embodiment of a process to install blade segments in a turbine.

FIG. 9 is a perspective view of the impact tool 96. As mentioned previously, the impact tool 96 includes the guide 102 that may move up and down with respect to the cross-members 106. The cross-members 106 are attached (e.g., welded) to the two legs 108. Each one of the two legs 108 is attached to a horizontal foot 110, forming a T-shaped base. The horizontal feet 110 have a length selected so as to create a base that is stable enough to prevent the tipping over of the impact tool 96 during operations. The horizontal feet 110 of the T-shaped base may have lockable wheels 112 (e.g., two wheels per foot) to allow the machine to be wheeled in the x-y plane and locked into position. The height of the legs 108 and feet 110 is such that the impact tool 96 can be wheeled over the intended impacting target (e.g., a lock blade 94 inserted into a turbine stage 82) with ease. In certain embodiments, the impact tool 96 may be fabricated from bar steel stock and plate steel stock and have the different components fastened (e.g., welded, riveted, screwed) together.

Figure 10:
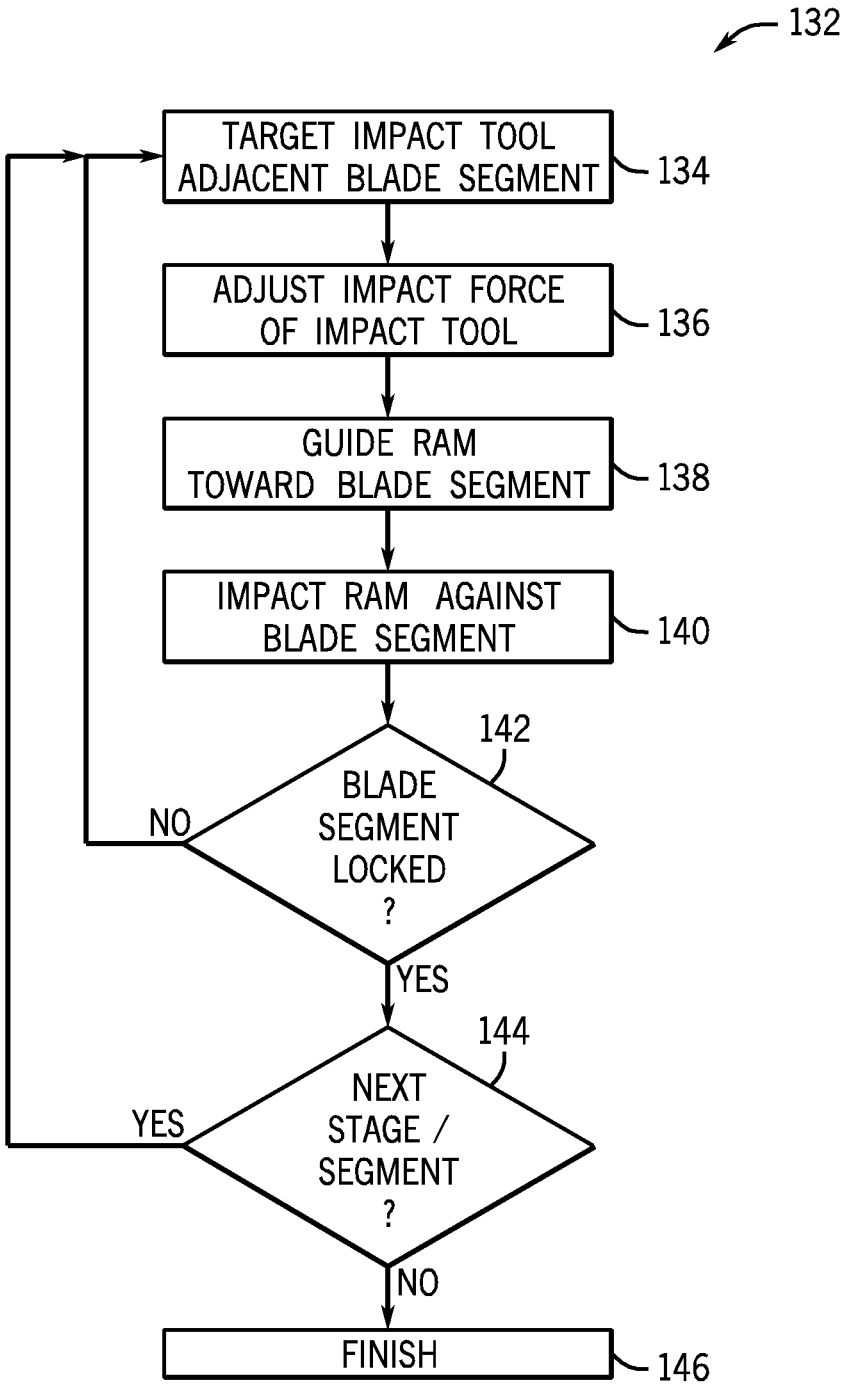

FIG. 10 is a flowchart of an embodiment of a process 132 (e.g., control logic) that may be used, for example, by the control system 98 to operate the impact tool 96. At a first step 134, the process 132 may execute one or more targeting instructions 134 to target the impact tool 96 relative to a blade segment (e.g., lock blade 94). For example, the process 132 may execute horizontal targeting instructions to move the frame 99, and thus the impact ram assembly 97, along a horizontal plane (e.g., axes 91 and 95) to center the impact ram 100 over the lock blade 94. By further example, the process 132 may execute vertical targeting instructions to move the vertical guide 102 into close proximity to (e.g., near or touching) the lock blade 94. Once the targeting 134 is complete, the process 132 may execute one or more impact force control instructions 136 to adjust the impact force suitable for the blade segment (e.g., lock blade 94). For example, the impact force control instructions 136 may increase or decrease a height of the impact ram 100 within the guide 102, thereby increasing or decreasing the gravity-driven impact force by the ram 100. The impact force control instructions 136 may account for the current position of the lock blade 94, the number of previous impacts, historical data, and upper limits on impact force for the lock blade 94 and/or the turbine stage. Once the impact force has been adjusted at block 136, the process 132 may execute an actuation command to release the ram 100 inside the guide 102, thereby guiding the ram 100 vertically toward the blade segment (block 138) until the impact ram strikes directly against the blade segment, e.g., lock blade 94 (block 140).

Following the impact of the ram 100 against the blade segment (e.g., lock blade 94), the process 132 queries whether or not the blade segment has been driven into a locked, final position (block 142). For example, the process 132 may obtain automatic feedback from a position sensor or manual feedback from a user. If the blade segment has not been driven into a locked, final position at block 142, then the process 132 may repeat by returning to block 134. If the blade segment has been driven into a locked, final position at block 142, then the process 132 queries whether or not another turbine stage needs to have a blade segment impacted (block 144). If there is another turbine stage requiring the impacting of a blade segment at block 144, then the process 132 may repeat by returning to block 134. If there is no turbine stage left that requires the impacting of a blade segment at block 144, then the process 132 may terminate at block 146.

Technical effects of the invention include the ability to reliably and repeatedly control the amount of impact force and the precise point of impact that may be used in impacting a ram into a target, and the lack of impact recoil due to the design of the impact machine. Other effects include the ability to quickly and easily move the machine and the guide into a proper target position. Further effects include the reduction in the time and in the number of impacts required to impact a lock bucket into the final, locking position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a blade installation tool, comprising:

a vertical guide having a vertical ram path; and a ram disposed along the vertical guide, wherein the ram is configured to move along the vertical ram path between a lower position and an upper position at a height above the lower position, the ram is driven by gravity from the upper position toward the lower position to provide an impact force of the ram against a blade segment of a turbine or a compressor, and the height of the upper position is variable to control the impact force, wherein the vertical guide comprises a lower end having a ram opening and a ram catch, the ram comprises a ram protrusion that extends through the ram opening in the lower position, and the ram comprises a ram abutment surface that rests on the ram catch in the lower position.

2. The system of claim 1, wherein the blade installation tool comprises a ram lift configured to move the ram along the vertical ram path between the lower position and the upper position.

3. The system of claim 2, wherein the ram lift comprises an electromagnet configured to selectively couple to the ram via a magnetic force.

4. The system of claim 2, wherein the ram lift comprises an impact force controller configured to adjust the height to adjust the impact force.

5. The system of claim 2, wherein the ram lift comprises a pulley, a cable extending along the pulley, and a drive coupled to the cable.

6. The system of claim 1, wherein the blade installation tool comprises a guide lift configured to move the vertical guide along a vertical guide path between a lowered guide position and a raised guide position.

7. The system of claim 6, wherein the blade installation tool comprises a spring coupled to the vertical guide and a frame, and the frame supports the vertical guide and the ram.

8. The system of claim 6, wherein the guide lift comprises a pulley, a cable extending along the pulley, and a drive coupled to the cable.

9. The system of claim 1, wherein the blade installation tool comprises a frame supporting the vertical guide, the ram, a guide lift coupled to the vertical guide, and a ram lift coupled to the ram, wherein the frame comprises lockable wheels, and the guide lift comprises a user input device configured to adjust the height to control the impact force.

10. A system, comprising:

a blade installation tool, comprising:

a guide having a ram path;

a ram disposed along the guide, wherein the ram is configured to move along the ram path between a first position and a second position offset from the first position, and the ram is driven from the first position toward the second position to provide an impact force of the ram against a blade segment of a turbine or a compressor;

an impact control configured to adjust the impact force; and a spring coupled to a lower end of the guide and configured to dampen a strike force of the ram against the lower end of the guide.

11. The system of claim 10, wherein the impact control comprises a series of marks disposed one after another along the guide, the first position of the ram is variable as indicated by the series of marks, and each mark represents a different magnitude of the impact force.

12. The system of claim 10, wherein the first position is disposed at a height above the second position, the ram is driven by gravity from the first position toward the second position, and the impact control is configured to adjust the height of the first position to control the impact force.

13. The system of claim 10, wherein the blade installation tool comprises a frame supporting the guide, the ram, the impact control, a ram positioner configured to move the ram along the ram path of the guide, and a guide positioner configured to move the guide along a guide path relative to the frame.

14. The system of claim 13, wherein the ram path is linear, the guide path is linear, and the ram path and the guide path are parallel to one another.

15. The system of claim 14, wherein the ram path and the guide path are vertical, the ram positioner comprises a ram lift, and the guide positioner comprises a guide lift.

16. The system of claim 15, wherein the ram positioner comprises an electromagnet configured to selectively couple to the ram via a magnetic force.

17. A system, comprising:

a turbine blade installation tool comprising;

a frame having a vertical guide path;

a vertical guide coupled to the frame, wherein the vertical guide is configured to move along the vertical guide path between a lower guide position and an upper guide position at a guide height above the lower guide position, and the vertical guide has a vertical ram path parallel with the vertical guide path;

a guide lift configured to move the vertical guide along the vertical guide path;

a ram coupled to the vertical guide, wherein the ram is configured to move along the vertical ram path between a lower ram position and an upper ram position at a ram height above the lower ram position, the ram is driven by gravity from the upper ram position toward the lower ram position to provide an impact force of the ram against a turbine blade of a turbine engine or compressor, and the ram height of the upper ram position is variable to control the impact force; and a ram lift configured to move the ram along the vertical ram path, wherein the vertical guide comprises a conduit having a vertical passage defining the vertical ram path, the conduit comprises a lower end having a ram opening and a ram catch at the lower ram position of the vertical ram path, the ram comprises a ram protrusion that extends through the ram opening in the lower ram position of the vertical ram path, the ram comprises a ram abutment surface that rests on the ram catch at the lower ram position of the vertical ram path, and the ram lift comprises an electromagnet configured to selectively couple to the ram via a magnetic force.

18. The system of claim 17, wherein the guide lift comprises a first cable and pulley system coupled to the frame, the ram lift comprises a second cable and pulley system coupled to the frame, the frame comprises a horizontal support extending between opposite first and second vertical legs, the vertical guide is coupled to the horizontal support, a first wheel is coupled to the first vertical leg, and a second wheel is coupled to the second vertical leg.

19. A system, comprising:

a blade installation tool, comprising:

a vertical guide having a vertical ram path; and a ram disposed along the vertical guide, wherein the ram is configured to move along the vertical ram path between a lower position and an upper position at a height above the lower position, the ram is driven by gravity from the upper position toward the lower position to provide an impact force of the ram against a blade segment of a turbine or a compressor, and the height of the upper position is variable to control the impact force, wherein the blade installation tool comprises a frame supporting the vertical guide, the ram, a guide lift coupled to the vertical guide, and a ram lift coupled to the ram, wherein the frame comprises lockable wheels, and the guide lift comprises a user input device configured to adjust the height to control the impact force.

20. A system, comprising:

a turbine blade installation tool comprising;

a frame having a vertical guide path;

a vertical guide coupled to the frame, wherein the vertical guide is configured to move along the vertical guide path between a lower guide position and an upper guide position at a guide height above the lower guide position, and the vertical guide has a vertical ram path parallel with the vertical guide path;

a guide lift configured to move the vertical guide along the vertical guide path;

a ram coupled to the vertical guide, wherein the ram is configured to move along the vertical ram path between a lower ram position and an upper ram position at a ram height above the lower ram position, the ram is driven by gravity from the upper ram position toward the lower ram position to provide an impact force of the ram against a turbine blade of a turbine engine or compressor, and the ram height of the upper ram position is variable to control the impact force; and a ram lift configured to move the ram along the vertical ram path, wherein the guide lift comprises a first cable and pulley system coupled to the frame, the ram lift comprises a second cable and pulley system coupled to the frame, the frame comprises a horizontal support extending between opposite first and second vertical legs, the vertical guide is coupled to the horizontal support, a first wheel is coupled to the first vertical leg, and a second wheel is coupled to the second vertical leg.

* * * * *